US008573549B2

(12) United States Patent
Holstad

(10) Patent No.: US 8,573,549 B2
(45) Date of Patent: Nov. 5, 2013

(54) RELEASABLE BRACKET FOR A WHEELCHAIR

(75) Inventor: Erik B. Holstad, Milwaukee, WI (US)

(73) Assignee: Adaptive Engineering Lab, Inc., Germantown, WI (US)

( * ) Notice: Subject to any disclaimer, the term of this patent is extended or adjusted under 35 U.S.C. 154(b) by 122 days.

(21) Appl. No.: 13/291,675

(22) Filed: Nov. 8, 2011

(65) Prior Publication Data

US 2013/0112827 A1 May 9, 2013

(51) Int. Cl.
*A47B 96/06* (2006.01)

(52) U.S. Cl.
USPC ..... 248/229.2; 248/229.1; 248/229.25; 248/229.15

(58) Field of Classification Search
USPC ..... 24/335, 337, 339; 269/3, 6, 95; 248/229.1, 229.11–229.15, 229.2, 248/229.21–229.25, 354.1, 354.3; 403/347, 403/356, 373, 377, 381, 109.1, 110, 117
See application file for complete search history.

(56) References Cited

U.S. PATENT DOCUMENTS

| | | | | |
|---|---|---|---|---|
| 3,249,388 | A | 5/1966 | Jennings | |
| 4,455,050 | A | 6/1984 | Kubek | |
| 5,538,167 | A * | 7/1996 | Winner | 224/425 |
| 6,370,741 | B1 * | 4/2002 | Lu | 24/523 |
| 7,114,715 | B1 * | 10/2006 | Kirk | 269/147 |
| 7,310,864 | B1 * | 12/2007 | Gingerich | 29/256 |
| 7,600,744 | B2 * | 10/2009 | Liou | 269/166 |
| 7,891,619 | B2 * | 2/2011 | Perlman | 248/229.14 |
| 2004/0238703 | A1 * | 12/2004 | Davies et al. | 248/229.24 |
| 2010/0032535 | A1 * | 2/2010 | Elliott | 248/229.22 |

* cited by examiner

*Primary Examiner* — Alfred J Wujciak
(74) *Attorney, Agent, or Firm* — Quarles & Brady LLP; George E. Haas

(57) ABSTRACT

A bracket, for attaching a support to a wheelchair frame, includes a coupling with a first body, a second body, and a link. The first body has a first bore with a clamp there around and has one connector for connection to the support or the wheelchair frame. The second body has a section with a second bore and which is received within the first bore and releasably engaged by the clamp. The second body has a second connector for connection to the other one of the support and the wheelchair frame. Releasing the clamp allows the first and second bodies to be separated so that the support can be moved with respect to the wheelchair frame, while the link, captured in the first and second bores, prevents total separation of the bodies. A key and keyway limit assembly of the first and second bodies in only one orientation.

28 Claims, 3 Drawing Sheets

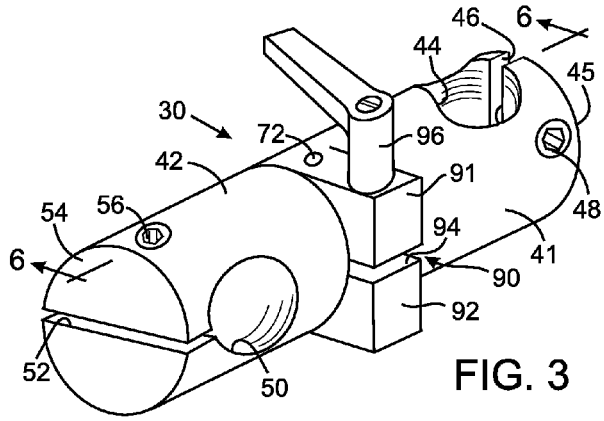
FIG. 3
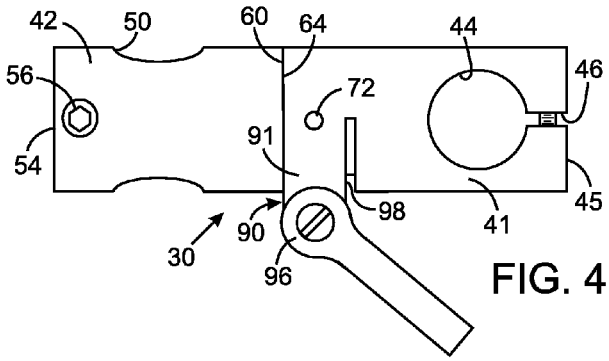
FIG. 4
FIG. 5
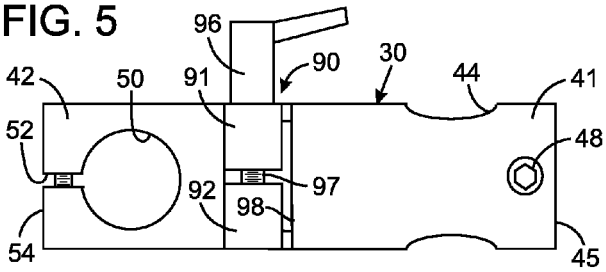
FIG. 6
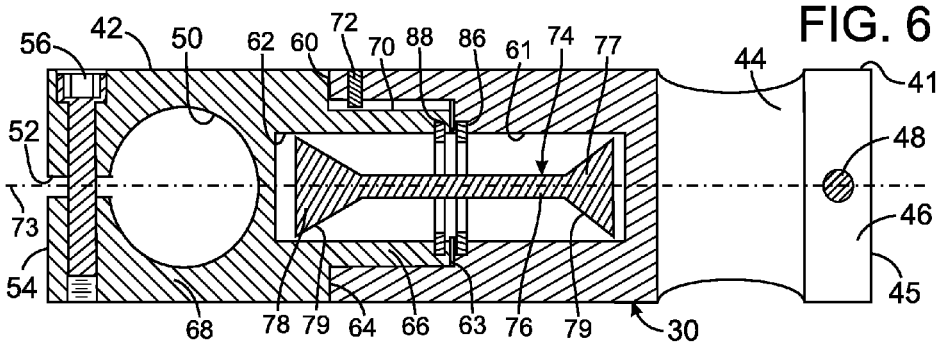

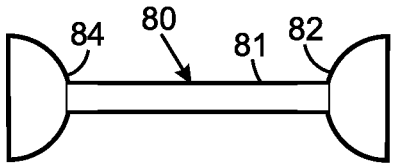
FIG. 7
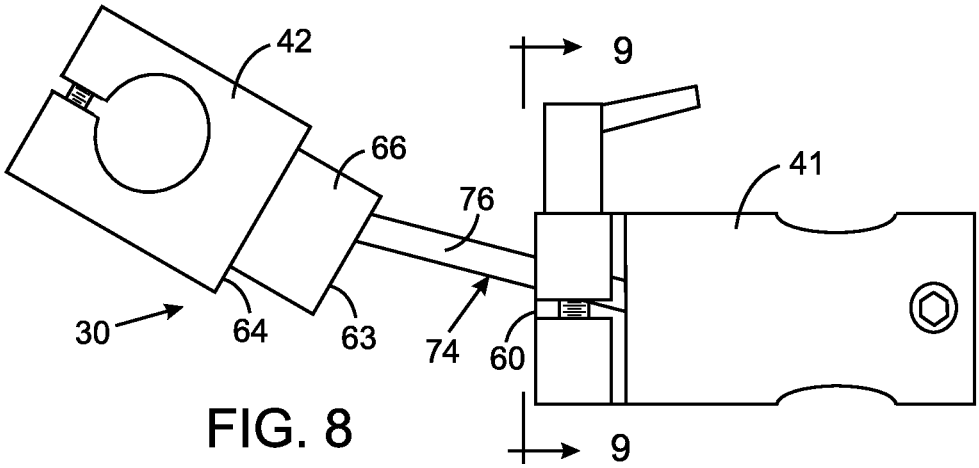
FIG. 8
FIG. 9
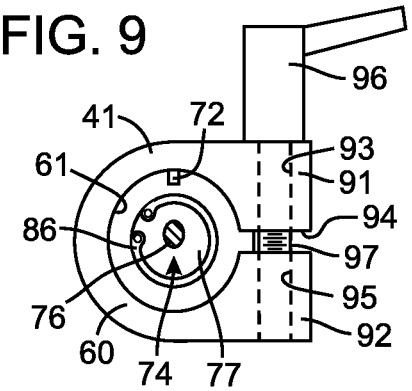

RELEASABLE BRACKET FOR A WHEELCHAIR

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to wheelchairs, and more particularly to brackets for attaching supports and other components to a frame of the wheelchair.

2. Description of the Related Art

Wheelchairs are commonly used by people who are unable to walk. The typical wheelchair has tubular metal frame with large rear wheels at each side and smaller front wheels which swivel. The frame is formed by a combination of elements, commonly referred to as "canes" that are connected together at various angles. In its simplest form, the seat of the wheelchair comprises a sheet of material which is hung between two spaced apart horizontal canes and a similar vertical sheet of material that is strung between two vertical rear canes to form the seat back. Although the flexible sheets of material conform somewhat to the contour of the user's body, this type of seat is not very comfortable for users who remain in the wheelchair for prolonged periods of time. Therefore, it is very common for those sheets to be replaced with aftermarket seat and back cushions.

The wheelchair frame also has a pair of left and right hanger canes that extend downward and forward from the two horizontal seat canes and terminate in supports for the wheelchair occupant's feet. Some wheelchair occupants lack sufficient leg muscle control to retain their legs in the proper position when seated. As a consequence, their legs often flop outward. It is not uncommon with elderly people that the knees spread part in this manner which causes the person to slide forward in the chair.

For these people, lateral knee supports are frequently attached to the left and right hanger canes to restrain the legs from spreading apart and maintain the person in the proper seated position in the wheelchair. A skilled medical person often initially positions the knee pads to provide adequate restraint and yet be comfortable to the wheelchair occupant. Nevertheless, the knee supports can interfere with the ability of the person to enter and leave the wheelchair and have to be removed or at least moved outward at those times. Thereafter the knee supports usually had to be properly re-positioned by a skilled medical person. In many situations, however, skilled medical personnel are not available, such as when the wheelchair is being used at home or elsewhere away from a medical facility. On those occasions, the unskilled caregiver assisting the wheelchair occupant may not restore the knee supports to the proper position.

Other types of supports, such as for the head of the wheelchair occupant, also have similar adjustment requirements.

Another problem is that some knee supports must be detached entirely from the frame to allow a person to enter or leave the wheelchair. At those times, the knee supports have to be placed somewhere away from the wheelchair. If the wheelchair then sits unused for a prolonged time, it may be moved away from the knee supports. Thus when the person needs to use the wheelchair again, a search has to be conducted for the knee supports.

Other styles of wheelchairs employ similar types of supports and their users encounter similar problems.

Therefore, there exists a need for a mechanism for attaching a support to a wheelchair that once adjusted into a proper position can be released and then easily restored to that proper position by other than skilled medical personnel.

SUMMARY OF THE INVENTION

A bracket for releasably attaching a support to a frame of wheelchair has a coupling. The coupling comprises first body and a second body with a link extending there between.

The first body has a first bore extending inwardly therein and has clamp. A first connector is adapted to connect the first body to one of the support and the frame of wheelchair The second body has a first section that is adapted to be received within the first bore and to be engaged by the clamp, thereby securing the first and second bodies together. A second bore extends inwardly into the second body. A second connector is adapted to connect the second body to another one of the support and the frame of wheelchair The link is movably received and captured in the first and second bores. The link allows the first and second bodies to separate and pivot about the link. In one version, the link has a first head captured in the first bore, a second head captured in the second bore, and a shaft attached to the first and second heads.

Another aspect of the invention is the inclusion of a stop which prevents rotation between the first and second bodies when the first section is received within the first bore. In one embodiment of that stop, either the first bore or the first section has a keyway and the other one of the first bore and the first section has a key that is received within the keyway when the first section is slid into the first bore.

Other components optionally may be provided. For example, a frame clamp can be releasably secured to one of the first and second connectors for attachment to the frame of wheelchair.

BRIEF DESCRIPTION OF THE DRAWINGS

FIG. 3 is a perspective view of a coupling of the releasable bracket;

FIG. 4 is a top view of the coupling;

FIG. 5 is a side view of the coupling;

FIG. 6 is a cross sectional view through the coupling along line 6-6 in FIG. 3;

FIG. 7 illustrates an alternative version of a component of the coupling;

FIG. 8 depicts two bodies of the coupling separated yet jointed together by a link; and FIG. 9 is a view along line 9-9 in FIG. 8 showing an end of one body of the coupling.

DETAILED DESCRIPTION OF THE INVENTION

Figure 1:
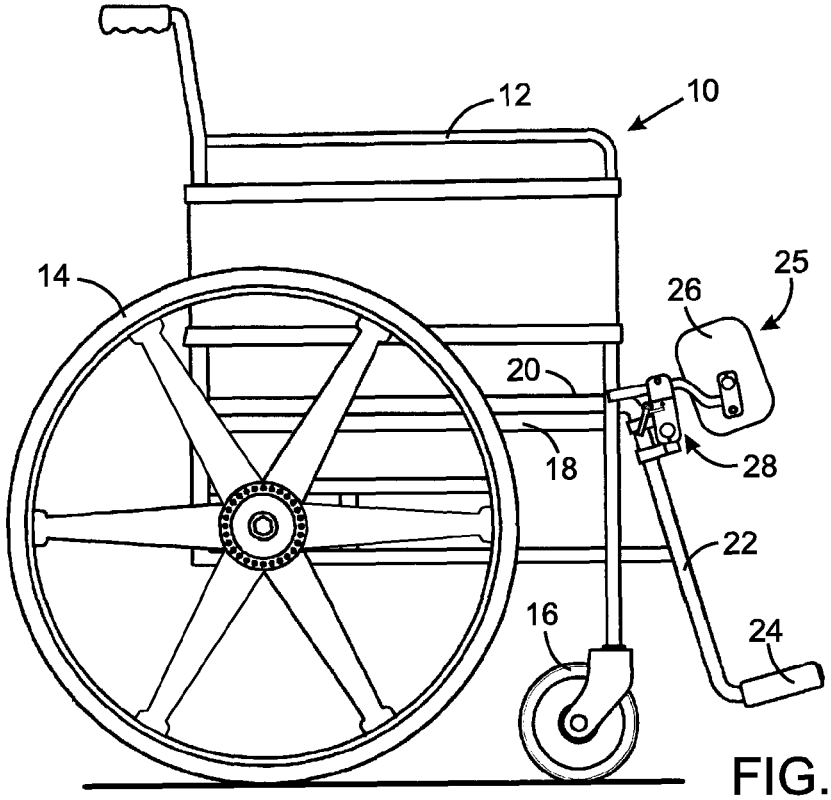
FIG. 1 is a side view of a wheelchair having a knee support mounted to the wheelchair frame by with a releasable bracket according to the present invention.

With initial reference to FIG. 1, a wheelchair 10 has a tubular metal frame 12 to which a pair of large rear wheels 14 and a pair of smaller front wheels 16 are mounted. A seat 18 is supported by horizontal canes 20 of the frame 12. A pair of hanger canes 22 project downward and forward from the front ends of the horizontal canes 20. Only one such hanger cane 22 on the right side of the wheelchair 10 is visible in FIG. 1. A foot rest 24 is attached at the bottom end of each hanger cane 22.

Figure 2:
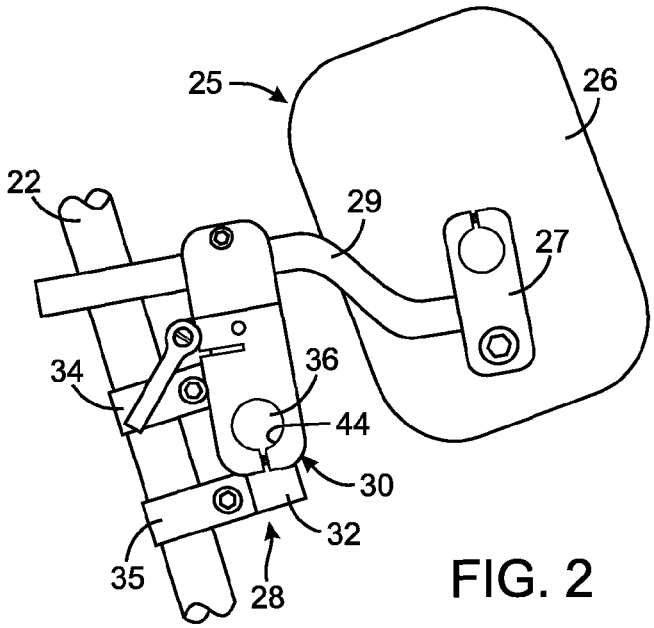
FIG. 2 is an enlarged view of the releasable bracket.

A separate knee support 25 is connected to each hanger cane 22 by a releasable bracket 28. The details of the knee support 25 and the bracket 28 are shown in FIG. 2. The knee support 25 includes a pad 26 is attached by a pivot member 27 to a rod 29 in a manner that allows the pad's orientation in three dimensions to be changed and then fixed with respect to the rod 29. The rod 29 passes through an aperture near one of a coupling 30 that is part of the bracket 28 and the coupling is tightened around the rod. Another aperture 44 near the opposite end of the coupling 30 is tightened around a stud 36 on a frame clamp 32. The frame clamp 32 has a two sets of jaws 34 and 35 that are secured onto one of the hanger canes 22. As will be described, a plurality of socket screws are used to clamp the components of the bracket 28 to one another and to the wheelchair frame 12 to maintain the knee support pad 26 in a fixed position with respect to the wheelchair frame. Other types of attachment devices can be employed, in place of the frame clamp 32, to connect the coupling 30 to the wheelchair frame. In addition, such an attachment device may attach the coupling 30 to a track or other component that is mounted on the wheelchair frame.

With reference to FIGS. 3-5, the coupling 30 comprises a generally cylindrical first body 41 and a generally cylindrical second body 42. The first body 41 has a first aperture 44 extending there through along one diametric axis and spaced from a first end 45 of the first body. A first slot 46, aligned with the first axis, extends through the first body from the first end 45 to the first aperture 44. With this arrangement, the first aperture 44 forms a first connector, into which the cylindrical stud 36 of the frame clamp 32 extends in the orientation of the bracket 28 shown in FIG. 2. A first socket screw extends through the first body 41 spanning the first slot 46. When a first socket screw 48 is tightened, the spacing of the first slot 46 closes reducing the diameter of the first aperture 44, thereby gripping the stud 36. This action secures the first body 41 to the frame clamp 32.

The second body 42 has a similar second aperture 50 extending there through along a diametric axis that is perpendicular to the diametric axis of the first aperture 44 in the assembled coupling 30. A second slot 52 extends from the second aperture 50 to a second end 54 of the second body 42. The second aperture 50 forms a second connector through which the rod 29 of the knee support 25 passes, in the orientation of the coupling 30 shown in FIG. 2. A second socket screw 56 extends through an aperture in the second body 42 and spans the second slot 52. When the second socket screw 56 is tightened, the spacing of the second slot 52 closes, reducing the diameter of the second aperture 50, thereby securely gripping the knee support rod 29.

Thus, tightening the first and second socket screws 48 and 56 secures the coupling 30 between the frame clamp 32 and the rod 29 of the knee support 25. By loosening the various socket screws, the components of the support 25 can be pivoted with respect to each other to properly align the pad for a particular user of the wheelchair 10. Once the knee support pad 26 has been properly positioned for that user, the socket screws can be tightened to hold the pad in that desired orientation.

It should be appreciated that the orientation of the coupling 30 may be reversed. That is, the frame clamp 32 may be attached via the second aperture 50 to the second body 42, and the support rod 29 may pass through the first aperture 44 in the first body 41. In other words, the first connector, comprising the first aperture 44, is adapted to connect the first body 41 to either one of the knee support 25 and the wheelchair frame 12, and the second connector, comprising the second aperture 50, is adapted to connect the second body 42 to the other one of the knee support 25 and the wheelchair frame 12. As used herein, the phrase "adapted to connect" means that the connector either directly or indirectly (e.g. by means of frame clamp 32, knee support rod 29, or a series of components) connects the associated body 41 or 42 to either the knee support 25 or the wheelchair frame 12.

With reference to FIG. 6, the first body 41 has a first bore 61 extending inwardly from a first inward end 60 of that body. The first bore 61 does not extend so far into the first body as to communicate with the first aperture 44.

The second body 42 includes a cylindrical first section 66 that has a reduced diameter so as to fit inside a portion of the first bore in the first body 41. Thus a second interior end 63 of the second body 42 is received within the first body when the coupling is assembled. A second bore 62 extends inwardly from the second interior end 63, but does not communicate with the second aperture 50, which is in a second section 68 of the second body 42. A flange surface 64 is formed between the first and second sections 66 and 68. When the first section 66 of the second body 42 extends fully into the first bore in the first body 41, the flange surface 64 faces the first inward end 60 of the first body 41.

A keyway 70 extends longitudinally along the exterior surface of the cylindrical first section 66 of the second body 42. The first bore 61 has a key 72, in the form of a pin, projecting inwardly from the interior surface of that bore. The key 72 is slideably received within the keyway 70 when the first and second bodies 41 and 42 are assembled as shown in FIG. 6. The engagement between the key 72 and the keyway 70 acts as a stop that inhibits the two bodies 41 and 42 from rotating with respect to each other about the longitudinal axis 73. Thus, when first and second bodies 41 and 42 are assembled together, a fixed perpendicular orientation is maintained between the two connector apertures 44 and 50. As will be described, the key and keyway combination, also ensures that a fixed orientation exists between the wheelchair frame 12 and the knee support pad 26 when the bracket 28 is in the assembled state as illustrated in FIGS. 1 and 2. Alternatively, the first bore 61 of the first body 41 and the first section 66 of the second body 42 may have a geometrical cross sectional shape, (e.g., rectangular) that serves as the stop that prevents rotation between the two coupling bodies 41 and 42.

With continuing reference to FIG. 6, in that fully assembled state of the coupling 30, the first and second bores 61 and 62 in the two bodies 41 and 42 are axially aligned. A link 74 is slideably received within those bores. The link 74 comprises a shaft 76 that extends between first and second heads 77 and 78. The first head 77 is received within the bore 61 of the first body 41 and the second head 78 is received within the bore 62 of the second body 42. Each of the heads has a sloping surface 79 facing toward the other head. For the exemplary link 74, the sloping surfaces 79 of the first and second heads 77 and 78 is beveled so that each head has a conical shape with the apex of the cone being truncated by the connection to the smaller diameter shaft 76.

An alternative link 80 is shown in FIG. 7. This link 80 has a shaft 81 connecting two hemispherical heads 82 and 84. Thus, for the alternative link 80, the sloping surfaces are hemispherical. It should be appreciated that other types of sloping surfaces may be employed.

Returning to FIG. 6, a first retaining ring 86 is received within a groove in the interior surface of the first bore 61 and a second retaining ring 88 is received within an annular groove in the second bore 62. The inner openings of each retaining ring 86 and 88 is smaller than the outer diameter of the first and second heads 77 and 78 of the link 74. Therefore, those heads are captured in, i.e., cannot be removed from, the respective bore as the heads cannot pass through the associated retaining ring, when the first and second bodies 41 and 42 are slid apart, as will be described.

Referring again to FIGS. 3-5 and 9, the first body 41 has a clamp 90 adjacent the inward end 60 that abuts the second body 42. The clamp 90 comprises first and second rectilinear blocks 91 and 92 that project laterally outward from one side of the first body 41 and that are separated by a gap 94. The first and second blocks 91 and 92 also are separated from the generally cylindrical portion of the first body 41 by a semicircular slot 98 that extends halfway through the first body. A first clamp aperture 93 through the first block 91 is aligned with a second clamp aperture 95 in the second block 92. The second clamp aperture 95 is threaded and receives a bolt 97 that extends from a clamp handle 96 through the unthreaded first clamp aperture 93. The clamp handle abuts the first block 91. Thus, when the clamp handle 96 is rotated in one direction, the threads draw the second block 92 toward the first block 91 and that action causes the blocks to exert a force on the outer circumferential surface of the first section 66 of the second body 42 that is within the first bore 61. This clamps the first body 41 to the second body 42 preventing their separation.

Rotation of the clamp handle 96 in the opposite direction releases the force that draws the two blocks 91 and 92 together, thereby disengaging the clamp 90 from tightly engaging the outer circumferential surface of the first section 66 of the second body 42. This allows the first and second bodies 41 and 42 to be separated by sliding them outwardly apart as shown in FIG. 8. However, the two bodies 41 and 42 still are joined together by the link 74. As noted previously, the two heads 77 and 78 of that link are captured within the respective first and second bores 61 and 62 by the retaining rings 86 and 88. The sloping surfaces 79 permit those heads to pivot within the respective bore, thus allowing the first and second bodies 41 and 42 also to pivot into a variety of positions with respect to one another.

This separation of the two coupling bodies 41 and 42 enables the knee support 25 to be released and moved outward when a person needs to sit down into the wheelchair or get up from the wheelchair. After a person is seated in the wheelchair, the coupling 30 again can be assembled by inserting the first section 66 of the second body 42 into the first bore 61 in the first body 41. As noted previously, the first body 41 has a key 72 that slides within a keyway 70 in the second body 42. Thus, the first and second bodies 41 and 42 only can be put together in one rotational relationship, which maintains the previously defined position of the knee support pad 26 with respect to the frame 12 of the wheelchair 10.

With this coupling 30, a skilled medical technician initially adjusts the position of the knee support pad 26 for a specific person using the wheelchair. Then by tightening the various socket screws on the components of the bracket 28, the knee support pad 26 is locked into that optimum position. Although the coupling 30 can be released to move the kneepad out of the way, so that a person can enter and leave the wheelchair, the coupling only may be reassembled in one orientation that maintains the optimum position of the knee support pad 26 with respect to the wheelchair frame 12 and its occupant. Therefore, an unskilled person, such as a family member or other caregiver, can assist a person into and out of the wheelchair and properly reposition the knee support pad in the specific position previously set by a skilled medical person. The link 74 also keeps the bracket components joined together, thereby preventing complete detachment of the knee support 25 from the wheelchair frame 12 and possible misplacement of the knee support.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A bracket for releasably attaching a support to a frame of a wheelchair, said bracket comprising:

a coupling having:

(a) a first body having a first bore extending inwardly therein, a clamp, and a first connector adapted to connect the first body to one of the support and the frame of the wheelchair;

(b) a second body having a second bore extending inwardly therein, a first section adapted to be received within the first bore and to be engaged by the clamp, and a second section with a second connector adapted to connect the second body to another one of the support and the frame of the wheelchair; and (c) a link slideably received and captured in the first and second bores, wherein the link allows the first and second bodies to separate and pivot about the link.

2. The bracket as recited in claim 1 wherein the first bore extends through the clamp.

3. The bracket as recited in claim 1 wherein one of the first bore and the first section has a keyway and the other one of the first bore and the first section has a key that is received within the keyway when the first section is within the first bore.

4. The bracket as recited in claim 1 further comprising a stop which prevents rotation between the first and second bodies when the first section is received within the first bore.

5. The bracket as recited in claim 1 wherein the first connector comprises a first aperture through the first body; and the second connector comprises a second aperture through the second body.

6. The bracket as recited in claim 5 further comprising a frame clamp for attachment to the frame of the wheelchair and having a stud secured into one of the first and second apertures.

7. The bracket as recited in claim 1 further comprising a frame clamp for attachment to the frame of the wheelchair and releasably secured to one of the first and second connectors.

8. The bracket as recited in claim 1 wherein the support comprises a rod and one of the first and second connectors is adapted to secure the rod to the coupling.

9. The bracket as recited in claim 1 wherein the link comprises a shaft having a first shaft end and a second shaft end, a first head attached to the first shaft end and having a first sloping surface, and a second head attached to the second shaft end and having a second sloping surface.

10. The bracket as recited in claim 9 wherein the first head has one of a conical shape and a hemispherical shape; and the second head has one of a conical shape and a hemispherical shape.

11. The bracket as recited in claim 9 wherein the first body has a first retainer for engaging the first sloping surface to prevent the link from being removed from the first bore; and wherein the second body has a second retainer for engaging the second sloping surface to prevent the link from being removed from the second bore.

12. The bracket as recited in claim 11 wherein first retainer comprises a first ring received in an annular groove in the first bore; and the second retainer comprises a second ring received in another annular groove in second first bore.

13. A bracket for releasably attaching a support to a frame of a wheelchair, said bracket comprising:

a coupling including:

(a) a first body having a clamp and a first connector adapted to connect the first body to one of the support and the frame of the wheelchair, (b) a second body having a first section adapted to be releasably engaged by the clamp, and a second section with a second connector adapted to connect the second body to another one of the support and the frame of the wheelchair, (c) a link coupled to the first and second bodies wherein the link allows the first and second bodies to separate from one another, wherein when the first and second bodies are separated the link ties the first body to the second body; and (d) a stop which prevents rotation of the first body with respect to the second body when the first section is received within the clamp.

14. The bracket as recited in claim 13 wherein the first body has a first bore extends inwardly therein, and the first section of the second body is further adapted to be received within the first bore.

15. The bracket as recited in claim 14 wherein the stop comprises one of the first bore and the first section having a keyway, and the other one of the first bore and the first section having a key that is received within the keyway when the first section is within the first bore.

16. The bracket as recited in claim 13 wherein the first connector comprises a first aperture through the first body; and the second connector comprises a second aperture through the second body.

17. The bracket as recited in claim 16 wherein:

the first body has a first bore extending inwardly therein;

the second body has a second bore extending inwardly therein; and the link comprises a first head captured in the first bore, a second head captured in the second bore, a shaft attached to the first and second heads, wherein the link allows the first and second bodies, when separated, to move about the link.

18. The bracket as recited in claim 17 wherein the first head has one of a conical shape and a hemispherical shape; and the second head has one of a conical shape and a hemispherical shape.

19. The bracket as recited in claim 17 wherein the first body has a first retainer in the first bore for engaging the first head to prevent the link from being removed from the first bore; and wherein the second body has a second retainer in the second bore for engaging the second head to prevent the link from being removed from the second bore.

20. The bracket as recited in claim 19 wherein first retainer comprises a first ring received in an annular groove in the first bore; and the second retainer comprises a second ring received in another annular groove in second first bore.

21. The bracket as recited in claim 13 wherein the stop prevents rotation of the first body with respect to the second body when the first section is released by the clamp.

22. A bracket for releasably attaching a support to a frame of a wheelchair, said bracket comprising:

a coupling having:

(a) a first body having a first bore extending inwardly therein, a clamp, and a first connector for attaching the first body securely to one of the support and the frame of the wheelchair;

(b) a second body having a second bore extending inwardly therein, a first section adapted to be received within the first bore and to be engaged by the clamp, and a second connector for attaching the second body securely to another one of the support and the frame of the wheelchair; and (c) a stop which prevents rotation between the first and second bodies when the first section is received within the first bore; and the bracket further comprising a link moveably received and captured in the first and second bores, wherein the link allows the first and second bodies to separate from one another in which state the link ties the first body to the second body.

23. The bracket as recited in claim 22 wherein the stop comprises one of the first bore and the first section having a keyway, and the other one of the first bore and the first section having a key that is received within the keyway when the first section is within the first bore.

24. The bracket as recited in claim 22 wherein the link comprises a first head captured in the first bore, a second head captured in the second bore, a shaft attached to the first and second heads.

25. The bracket as recited in claim 24 wherein the first body has a first retainer for engaging the first head to prevent the link from being removed from the first bore; and wherein the second body has a second retainer for engaging the second head to prevent the link from being removed from the second bore.

26. The bracket as recited in claim 24 wherein the first head has one of a conical shape and a hemispherical shape; and the second head has one of a conical shape and a hemispherical shape.

27. The bracket as recited in claim 22 wherein the first connector comprises a first aperture through the first body; and the second connector comprises a second aperture through the second body.

28. The bracket as recited in claim 22 wherein the clamp engages an exterior surface of the second body to secure the first and second bodies together.

* * * * *